US005231240A

United States Patent [19]

Lu

[11] Patent Number: 5,231,240

[45] Date of Patent: Jul. 27, 1993

[54] DIGITAL TONE MIXER

[75] Inventor: Wei-Fan Lu, Hsin-Chu City, Taiwan

[73] Assignee: Hualon Microelectronics Corporation, Hsin-Chu City, Taiwan

[21] Appl. No.: 822,544

[22] Filed: Jan. 17, 1992

[51] Int. Cl.[5] ..... G10H 1/08; G10H 1/46

[52] U.S. Cl. ..... 84/660; 84/665; 84/DIG. 23

[58] Field of Search ..... 84/625, 633, 660, 665, 84/675-677, 697, 698, 711, DIG. 11, DIG. 23

[56] References Cited

U.S. PATENT DOCUMENTS 4,934,239 6/1990 Tsai ..... 84/DIG. 11

*Primary Examiner*—Stanley J. Witkowski

*Attorney, Agent, or Firm*—Ladas & Parry

[57] ABSTRACT

A digital tone mixer includes a first digital volume regulator electrically connected to a first tone generator and having a binary signal output corresponding to the desired amplitude of a pulsating tone signal from the first tone generator; a second digital volume regulator electrically connected to a second tone generator and having a binary signal output corresponding to the desired amplitude of a pulsating tone signal from the second tone generator; a binary adder for summing the binary signal outputs of the first and second volume regulators; and a pulse rate modulator receiving a binary output from the binary adder and generating a pulse train which has a pulse density corresponding to the binary output of the binary adder. The digital tone mixer has a very stable output characteristic.

18 Claims, 3 Drawing Sheets

DIGITAL TONE MIXER

FIELD OF THE INVENTION

The present invention relates to a digital mixer, and more particularly to a digital tone mixer.

DESCRIPTION OF THE PRIOR ART

It is known that the generation of a mixed tone in the prior art is obtained by converting two individual digital tone signals into two individual analog signals and then mixing the two analog tone signals by means of an analog summer so as to obtain a mixed tone. However, because of the use of linear elements in the conventional analog tone mixer, the output characteristic of the tone mixer is relatively unstable and will affect the operation of other devices, such as an amplifier, connected thereto. Therefore, it is necessary to provide a tone mixer which does not use linear elements so as to obtain a more stable output characteristic.

SUMMARY OF THE INVENTION

Accordingly, the object of the present invention is to provide a digital tone mixer having a stable output characteristic.

In order to achieve the above-mentioned object, a digital tone mixer according to the present invention comprises: a first digital volume regulator electrically connected to a first tone generator and having a binary signal output corresponding to the desired amplitude of a pulsating tone signal from said first tone generator; a second digital volume regulator electrically connected to a second tone generator and having a binary signal output corresponding to the desired amplitude of a pulsating tone signal from said second tone generator; a binary adder for summing the binary signal outputs of said first and second volume regulators; and a pulse rate modulator receiving a binary output from said binary adder and generating a pulse train which has a pulse density corresponding to the binary output of said binary adder.

BRIEF DESCRIPTION OF THE DRAWINGS

The feature, object and advantages of the present invention will become apparent to those of ordinary skill in the art by reviewing the detailed description below of the preferred embodiments in connection with the attached drawings, of which.

DESCRIPTION OF THE PREFERRED EMBODIMENTS

Figure 1:
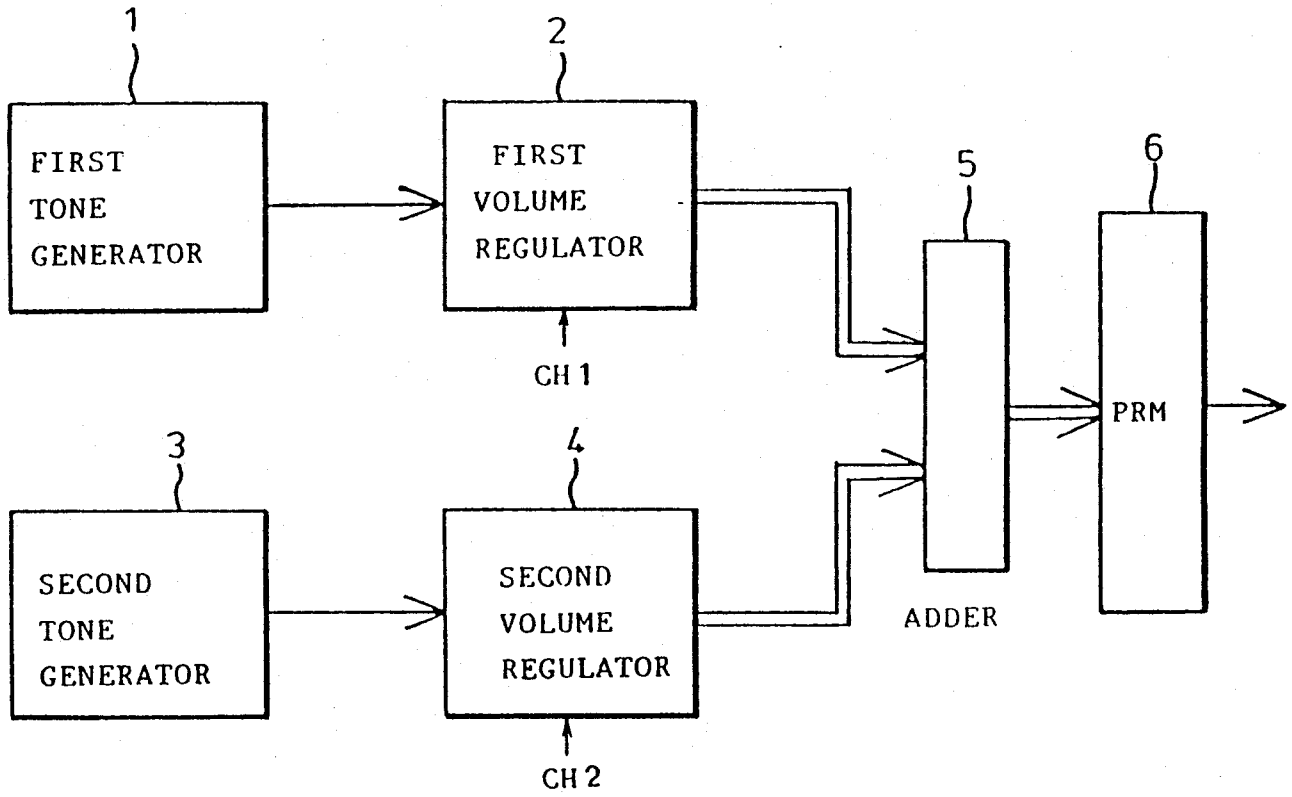
FIG. 1 shows a block diagram of the preferred embodiment of a digital tone mixer according to the present invention.

Referring to FIG. 1, a digital tone mixer according to the present invention essentially comprises a first digital volume regulator (2) in connection with a first digital tone generator (1), a second volume regulator (4) in connection with a second digital tone generator (3), a binary adder (5), and a pulse rate modulator (6). The first and second tone generators (1, 3) can produce square wave signals representative of a first and a second pulsating tone signal, respectively. The first and second pulsating tone signals can be of any frequencies, such as in the range of 300 Hz to 4000 Hz, and are provided to the first and the second volume regulators (2, 4) respectively.

Figure 2:
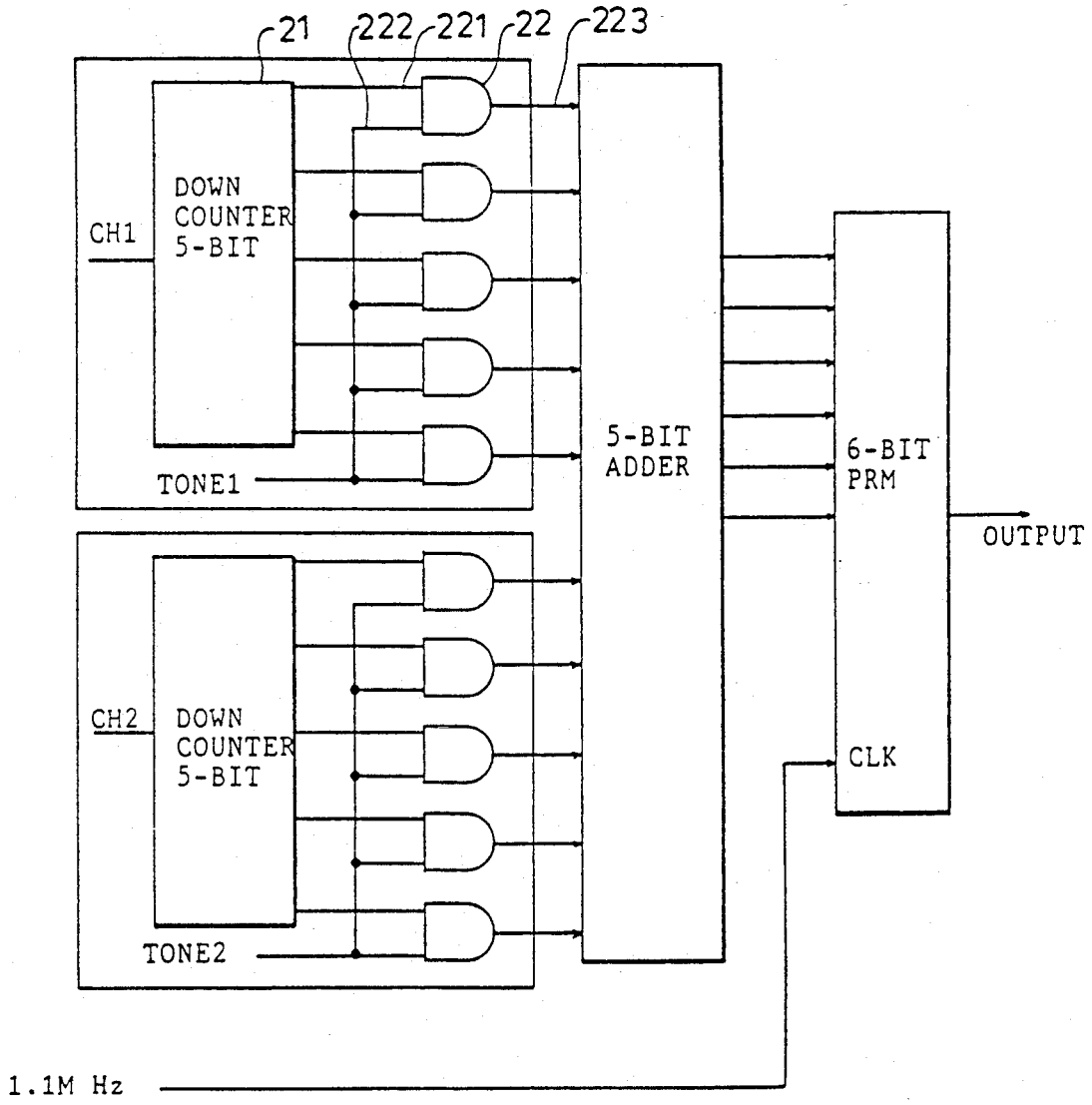
FIG. 2 is a more detailed schematic block diagram of the mixer shown in FIG. 1.

A more detailed construction of the volume regulators (2, 4) according to this invention is shown in FIG. 2. Since the construction of the first volume regulator is the same as that of the second volume regulator, only the first volume regulator is described below. As shown in FIG. 2, a volume regulator (2) comprises a five-bit 31-stage down counter (21) and five AND gates (22), and functions as an envelope generator. One of the inputs (221) of each AND gate (22) is connected to a respective output line of the down counter (21). The other inputs (222) of the five AND gates (22) are connected to the digital tone generator. The counter (21) is controlled by a control means (not shown) capable of providing a sequential programming clock (CH1) to trigger and control the down-counting operation of the counter (21). It can be appreciated that if the output of the counter (21) is of a large value, the sound generated by a speaker connected to the digital tone mixer of this invention will be correspondingly large. By contrast, if the output of the counter (21) is of a small value, the sound generated by the speaker will be correspondingly small. The output lines of the volume regulators (2, 4) are connected to a binary adder as described below.

The binary adder (5) shown in FIG. 1 is a known 5-bit adder. The adder will combine the signals from the outputs of the two volume regulators (2, 4) and will produce a 6-bit output, including a carry bit.

Figure 3:
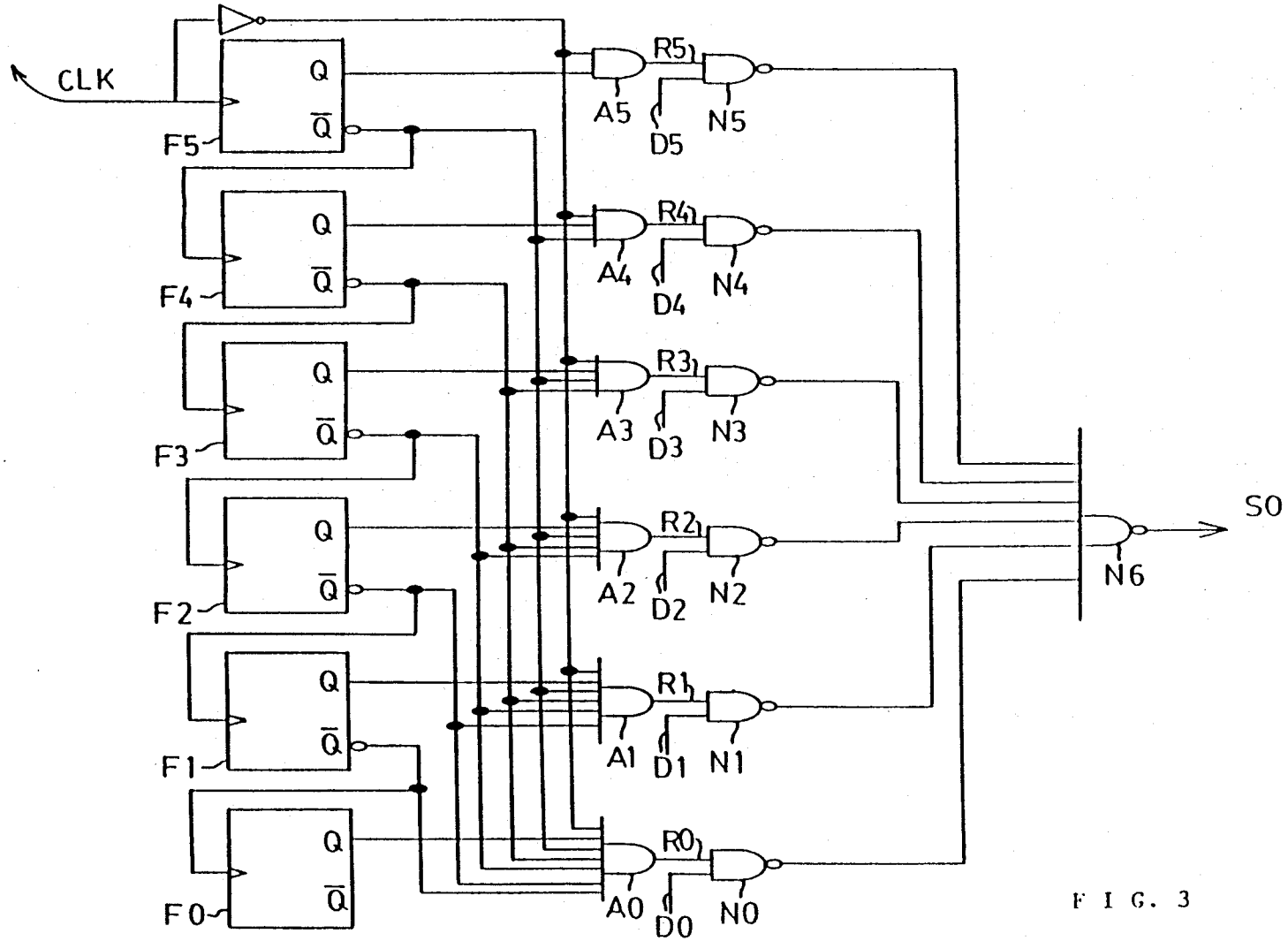
FIG. 3 is a logic circuit diagram of a pulse rate modulator used in the present invention.

FIG. 3 shows the construction of a pulse rate modulator (6) according to the present invention. The modulation means (6) comprises seven NAND gates (N0–N6) and a frequency divider consisting of six flip-flops (F0–F5), a NOT gate and six AND gates (AO–A5). The CLK input to the pulse rate modulator (6) is connected to a pulse generator (not shown). The inputs (D0–D5) of the NAND gates (N0–N5) are connected to the output lines of the adder (5), while the inputs (R0–R5) thereof are connected to the outputs of the frequency divider.

It can be appreciated that if the frequency of the CLK signal is f0 Hz, then the frequencies of the signals at the outputs of R5 to R0 of the AND gates A5–A0 will be f0/2 Hz, f0/4 Hz, f0/8 Hz, f0/16 Hz, f0/32 Hz, and f0/64 Hz, respectively. In this example, the frequency of the CLK signal is 1.1 MHz as shown in FIG. 2.

With the combination of the signals from the frequency divider and that from the adder, the pulse rate modulator (6) will provide a pulse train (SO) at the output of the NAND gate (N6) which pulse train (SO) is variably controlled by the signals from the adder (5). The pulse train can serve as an input to a sound generator, such as a speaker or buzzer, so as to generate a tone-mixed sound.

In a further embodiment, the first and second tone signals from the two tone generators can be generated alternately in time. Thus an echo effect will be created.

Although the present invention has been described in connection with the preferred embodiments thereof, it is to be noted that numerous changes and modifications will become apparent to those skilled in the art. Accordingly, such changes and modifications, of the present invention, are to be understood as encompassed in the present invention as defined by the appended claims.

I claim:

1. A digital tone mixer, comprising:

a first digital volume regulator for electrical connection to a first tone generator and providing a first binary signal output corresponding to a first desired amplitude of a pulsating tone signal from said first tone generator;

a second digital volume regulator for electrical connection to a second tone generator and providing a second binary signal output corresponding to a second desired amplitude of a pulsating tone signal from said second tone generator;

a binary adder for summing said first and second binary signal outputs of said first and second digital volume regulators into a binary output signal; and a pulse rate modulator for generating a pulse train that has a pulse density corresponding to said binary output signal.

2. The digital tone mixer as claimed in claim 1, wherein each of said first and second digital volume regulators comprises a five-stage down counter having five output lines and five two-input AND gates, each of said AND gates having a first input connected to a respective one of said output lines of said down counter and a second input for receiving said pulsating tone signal from the corresponding one of said first and second tone generators.

3. The digital tone mixer as claimed in claim 1, wherein said first desired amplitude is different from said second desired amplitude.

4. The digital tone mixer as claimed in claim 2, wherein said first desired amplitude is different from said second desired amplitude.

5. The digital tone mixer as claimed in claim 1, wherein said first desired amplitude is the same as said second desired amplitude.

6. The digital tone mixer as claim in claim 2, wherein said first desired amplitude is the same as said second desired amplitude.

7. The digital tone mixer as claimed in claim 1, wherein said first binary signal output is different from said second binary signal output.

8. The digital tone mixer as claimed in claim 2, wherein said first binary signal output is different from said second binary signal output.

9. The digital tone mixer as claimed in claim 3, wherein said first binary signal output is different from said second binary signal output.

10. The digital tone mixer as claimed in claim 4, wherein said first binary signal output is different from said second binary signal output.

11. The digital tone mixer as claimed in claim 5, wherein said first binary signal output is different from said second binary signal output.

12. The digital tone mixer as claimed in claim 6, wherein said first binary signal output is different from said second binary signal output.

13. The digital tone mixer as claimed in claim 1, wherein said first binary signal output is the same as said second binary signal output.

14. The digital tone mixer as claimed in claim 2, wherein said first binary signal output is the same as said second binary signal output.

15. The digital tone mixer as claimed in claim 3, wherein said first binary signal output is the same as said second binary signal output.

16. The digital tone mixer as claimed in claim 4, wherein said first binary signal output is the same as said second binary signal output.

17. The digital tone mixer as claimed in claim 5, wherein said first binary signal output is the same as said second binary signal output.

18. The digital tone mixer as claimed in claim 6, wherein said first binary signal output is the same as said second binary signal output.

* * * * *